United States Patent [19]

Greven

[11] Patent Number: 4,761,998

[45] Date of Patent: Aug. 9, 1988

[54] TESTING DEVICE FOR ORDNANCE

[75] Inventor: Hillebrand J. Greven, LH Delft, Netherlands

[73] Assignee: RMO-Wrkspoor Srvices BV, Netherlands

[21] Appl. No.: 755,732

[22] Filed: Jul. 17, 1985

[30] Foreign Application Priority Data

Jul. 20, 1984 [NL] Netherlands ..... 8402313

[51] Int. Cl.[4] ..... G01L 5/14

[52] U.S. Cl. ..... 73/167

[58] Field of Search ..... 73/167, 11, 12; 124/7, 124/36

[56] References Cited

U.S. PATENT DOCUMENTS

| | | | |
|---|---|---|---|
| 2,518,466 | 8/1950 | Hanson | 73/11 |
| 3,285,052 | 11/1966 | Lothrop, Jr. | 73/830 |
| 3,437,291 | 4/1969 | Bochman, Jr. | 244/63 |
| 3,626,451 | 12/1971 | Bourgeot | 73/167 |
| 3,693,432 | 9/1972 | Stewart et al. | 73/167 |
| 4,069,702 | 1/1978 | Hayner | 73/167 |
| 4,505,153 | 3/1985 | Lilley et al. | 73/167 |
| 4,554,838 | 11/1985 | Paus | 73/834 |

FOREIGN PATENT DOCUMENTS 2059956 6/1972 Fed. Rep. of Germany .

*Primary Examiner*—William A. Cuchlinski, Jr.
*Assistant Examiner*—W. Morris Worth
*Attorney, Agent, or Firm*—John P. Snyder

[57] ABSTRACT

An ordnance piece is subjected to testing which approximates the time history of forces on the piece during actual firing thereof. A mass of predetermined weight is impelled to a predetermined velocity so that it attains a kinetic energy capable, upon deceleration to standstill, of imposing the desired time history of forces upon the brake and return mechanism of the ordnance piece. The force is applied to the muzzle of the barrel of the piece or to a dummy barrel and the energy transfer is effected in two stages of deceleration, the first stage being a cushioned stage and the second stage being a full impact or uncushioned stage. This results in a time history of forces acting upon the barrel in which the force increases from zero to a peak value and then decreases from this peak value to zero, thus approximating the actual time history of forces during actual firing of the piece. In order to assure that the desired kinetic energy is imparted to the mass, an impelling gas pressure is built up against a plunger and it is then held in this position against the mass and released by destruction of an attachment without significant variation of the gas pressure. Thus, control of the mass weight and the gas pressure allows a precise kinetic energy to be imparted to the mass.

27 Claims, 6 Drawing Sheets

2
17
19
21
22
23
24
25
28
35
36
37
38
39
40
41
42
43
44
45
46
47
49
50
51
52
57
58
91
94
101
102
103
104
105
106
107
110
111
112
113
114
115
126
53
V
Y 24
60
62
80
81
82
83
84
q

TESTING DEVICE FOR ORDNANCE

BACKGROUND AND BRIEF SUMMARY OF THE INVENTION

The invention relates to a method for testing a brake and return mechanism of an artillery barrel whereby a backward thrust is applied to the muzzle of a barrel and the behaviour of the brake and return mechanism is recorded.

In the known art, the backward thrust is applied to the muzzle by means of a ram, which is fired against the muzzle when the powder in the powder chamber explodes. Such a powder chamber is only suitable for a determined powder charge so that a particular apparatus used is only suitable for testing brake and return mechanisms of one determined dimension. The use of powder is dangerous and the noise it causes is a nuisance. The impulse of the test thrust applied cannot be reproduced accurately.

The invention has for its object to provide an improved method whereby varying brake and return mechanisms can be tested with one and the same apparatus, resulting in considerably less noise and danger than is caused in the case of powder explosions and /or in it being possible to carry out the test more accurately. To achieve this with the method according to the invention, the thrust on the muzzle is applied by means of at least one pretensioned gas cylinder being released.

If the gas cylinder is released by destruction of attachment means, said gas cylinder is freed in a simple manner.

An object of the invention is to provide a method of testing the recoil and return mechanism of ordnance pieces by subjecting same to an energy impulse applied to the muzzle of the barrel of the piece or of a dummy barrel in which the energy impulse is the kinetic energy of a mass initially transferred resiliently to the barrel. The kinetic energy transfer causes the barrel or dummy to be subjected to forces varying with time which approximate the time history of forces which would be applied to the piece if it were actually being fired. The force/time diagram caused by the energy transfer is recorded as a record of the test.

In regard to the above objective, it is of paramount concern that the time history of forces acting upon the piece during actual firing thereof be approximated during the test. This time history is approximated by (1) assuring that the kinetic energy imparted to the mass is accurately of a predetermined value and (2) that the kinetic energy transfer to the piece is initially cushioned in controlled fashion to produce a force which increases with time to a peak value and thereafter, subsequent to such cushioning, decreases with time to zero. Stated otherwise, the kinetic energy transfer may be thought of as occurring in two stages of mass deceleration, the first stage being relatively gradual and the second stage being relatively abrupt. The transition between stages is marked by the cessation of the cushioned transfer and the onset of full impact transfer.

Another object of the invention is to provide a method in which the kinetic energy imparted to the mass is closely controlled. To this end, the mass impelling plunger is "loaded" with a predetermined gas pressure, the plunger is locked in position while this gas pressure prevails, and the plunger is then released from this position by destruction of a restraining member. In this way, the prevailing pressure of the gas is closely controlled so that the mass is impelled to a predetermined velocity and thus, because its weight is also controlled, has a predetermined kinetic energy before its kinetic energy is transferred to the ordnance piece.

Another object of the invention is the provision of apparatus for carrying out the method of this invention.

Other and different objects of the invention will become apparaent as the following description proceeds.

BRIEF DESCRIPTION OF THE DRAWING FIGURES;

In the drawing:

FIG. 1 a top view of a test site having an apparatus according to the invention, FIG. 2 a schematic survey of successive stages in the carrying out of a preferred embodiment of the method according to the invention, FIGS. 3, 4 and 5 a schematic top view of the apparatus according to the invention in three different positions, FIGS. 6 and 7 respectively top and side views—partially in section—of the preferred embodiment of the apparatus according to the invention, FIGS. 8 a section along the line VIII—VIII of FIG. 6, FIG. 9 a section along the line IX—IX of FIG. 7, FIGS. 10 and 11 a partial section along the line X—X of FIG. 9 in two different positions, FIG. 12 on a larger scale a view—partially in section—along the broken line XII—XII of FIG. 9, FIG. 13 on a larger scale detail XIII of FIG. 1, and FIG. 14 on a larger scale a variant of detail VIX of FIG. 13.

DETAILED DESCRIPTION

Figure 1:
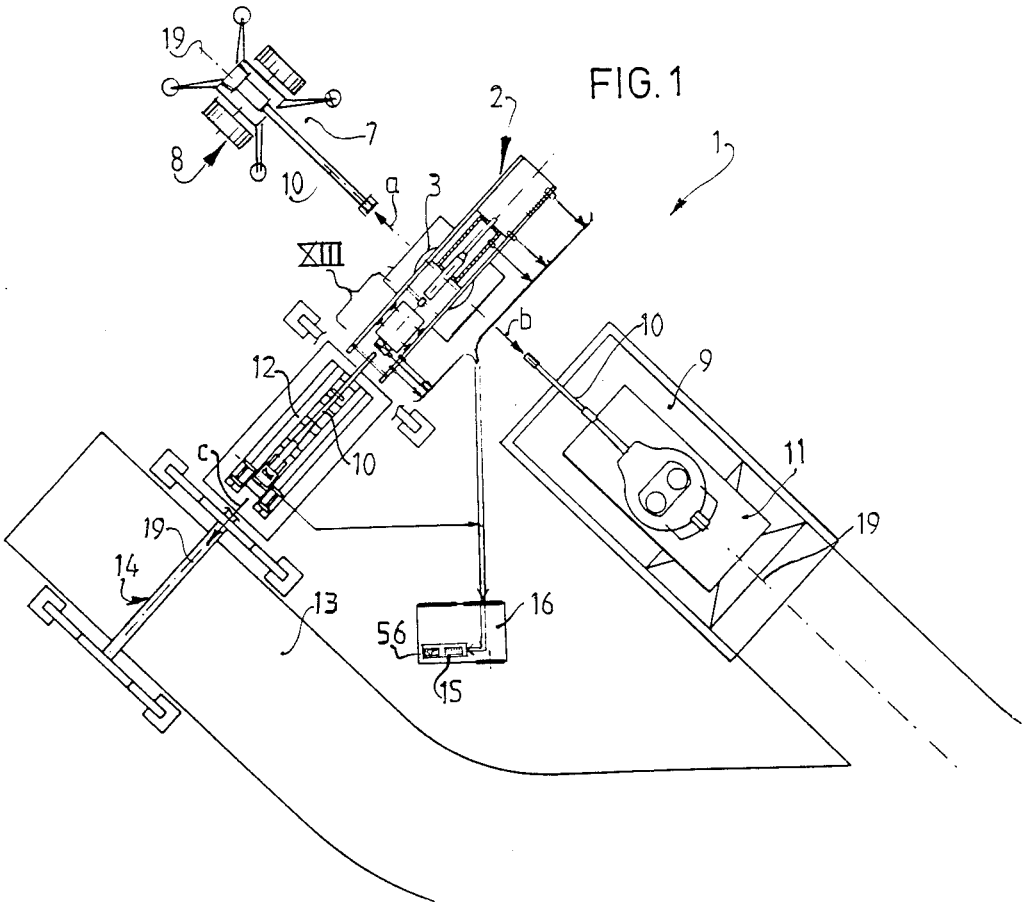

On a test site 1 according to FIG. 1 a testing apparatus 2 is set up, whereof a frame 25, rotable on a rotary crown 3 (FIG. 7), is set up and attached via said rotary crown 3 firmly to a frame 4 which is embedded in a concrete foundation 5.

Figure 5:
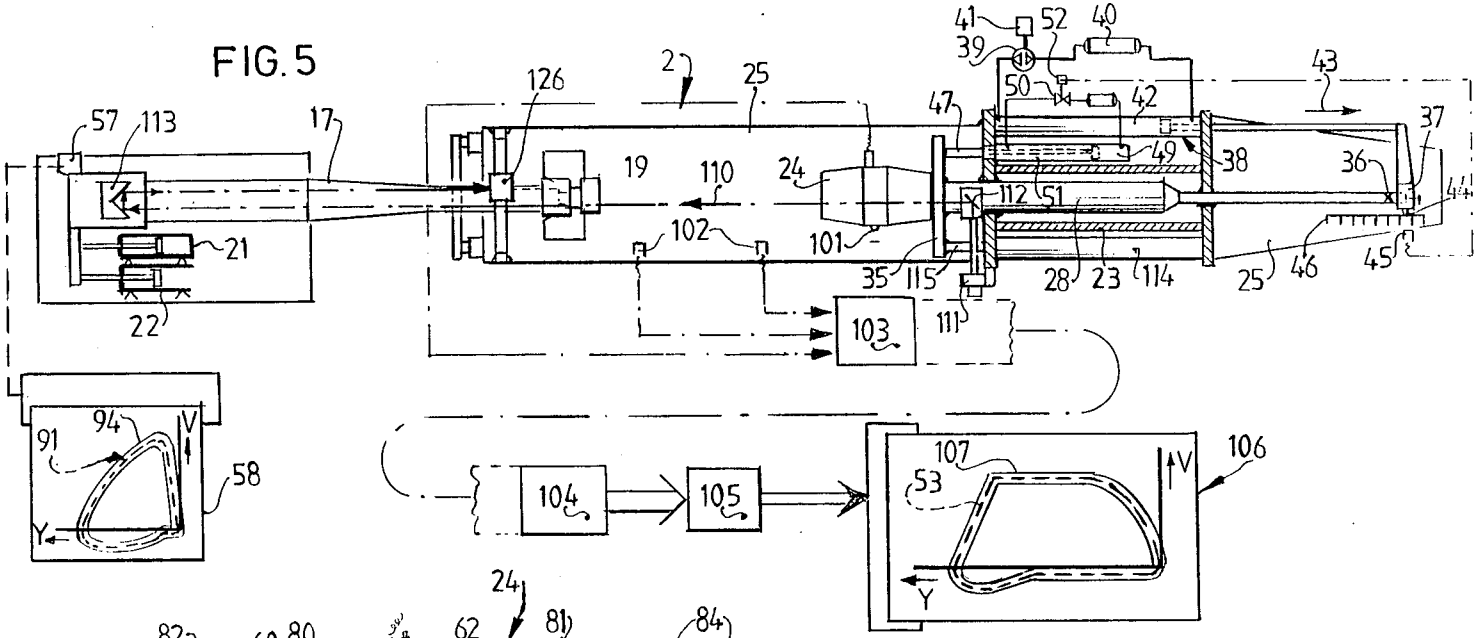

By means of the gear ring 6, the apparatus 2 is adjustable in any of the directions a, b or c, in which respectively the barrel 10 of an artillery piece 8 positioned at ground level 7, the barrel 10 of a tank 11 positioned in a pit 9 or a barrel 10 set up on a holding device 12 is to be removed by vehicle on a road 13 and be conveyed onto and off the holding device 12 by means of a mobile crane 14. Recording means 15 of the apparatus 2 are set up in a closed control room 16 for recording the various diagrams including information concerning the diagram 56 (see FIG. 1) which is the time history of forces F acting during time t upon the brake and return mechanism of the ordnance piece (see also FIG. 2 for the diagrams 59 and 53 as well). As is later explained, the recorder 58 records the velocity-trajectory test diagram 91 and this test diagram is compared with the band 94 to determine if the test diagram 91 lies within such band 94. It will be appreciated that the force-time diagram 56 represents the kinetic energy impulse transferred by the mass 24 to the ordnance piece to effect recoil thereof. Referring to FIG. 5, the force-time diagram 56 is represented by that portion of the velocity-trajectory diagram 91 during which the velocity V is positive and the trajectory Y is increasing. The return mechanism of the ordnance piece generates that portion of the velocity-trajectory diagram 91 during which the velocity V is negative and the trajectory Y is decreasing.

Figure 6:
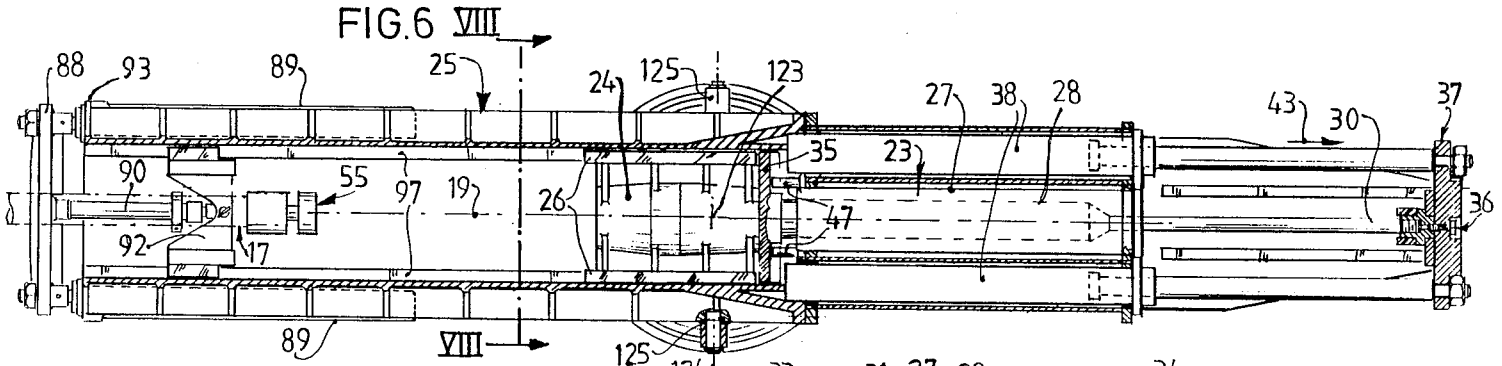
Figure 7:
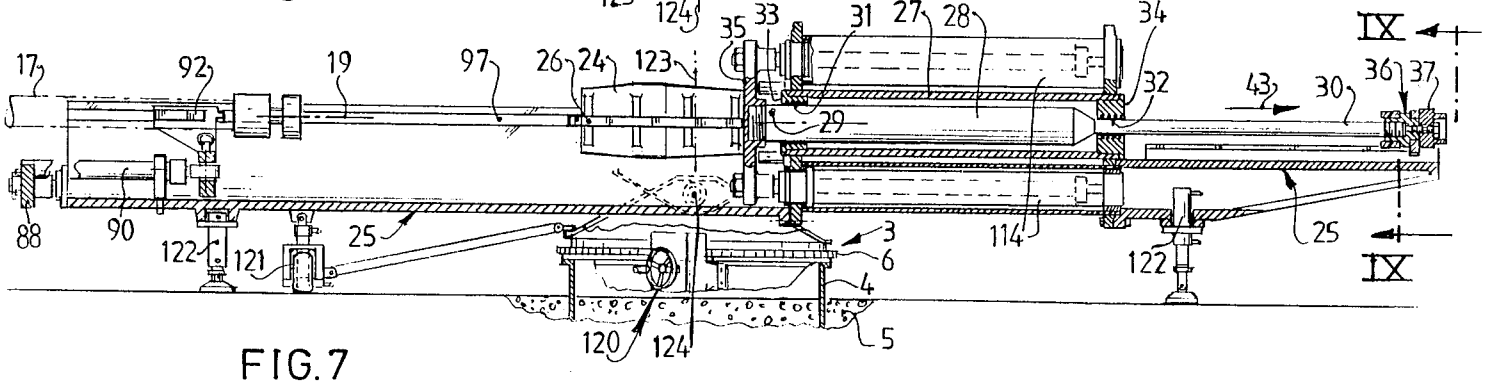
Figure 8:
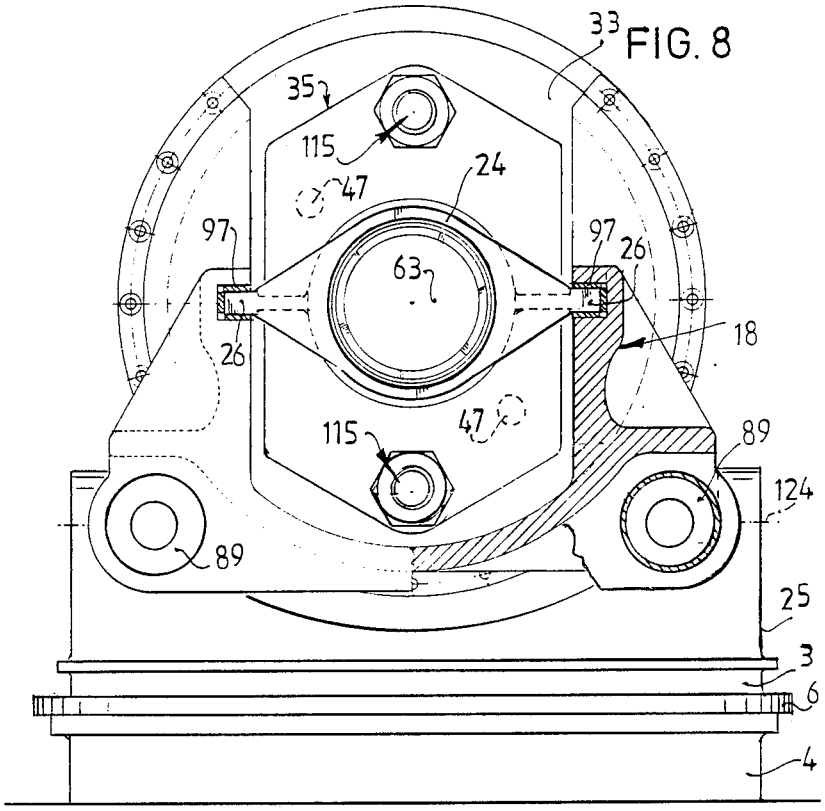

In the method according to the invention (see FIG. 2) a frame 18 of the barrel 10 is anchored firmly to the site 1, placed such that the muzzle 17 can be adjusted to point towards the apparatus 2 in the line 19 of direction a, b or c, said line 19 being the axial operative line of said apparatus 2 and which is coaxial with the longitudinal axis of the barrel 10. The barrel 10 comprises a brake and return mechanism 20, with which the muzzle 17 is connected, displaceable in axial direction of the line 19 relative to the frame 18 (FIGS. 6 and 7). Said brake and return mechanism 20 comprises a brake cylinder 21 for slowing down the recoil movement of the muzzle 17 and a resetting cylinder 22 filled with nitrogen operating as a resetting spring.

The apparatus 2 comprises a dischargeable mass 24, which is guided in the direction of the axial line 19 along guides 97 of the frame 25 by means of guide members 26.

Said apparatus 2 further comprises a gas cylinder 23, preferably a nitrogen cylinder, which is set up in the direction of the axial line 19. Said gas cylinder 23 is assembled from a housing 27 rigidly connected with the frame 25 and an axially slidable plunger 28. Said plunger 28 has a thick thrust end 29 and a thin tensioning end 30 which are pushed into the housing ends 33, 34, closed off by means of seals 31, 32. The thrust end 29 is coupled with a thrust yoke 35, while the tensioning end 30 is coupled via destructible means 36 with a tensioning yoke 37, on which two plungers of hydraulic tensioning cylinders 38 are offixed. Said tensioning cylinders 38 are actuated by a hydraulic pump 39, driven by an electric motor 41, which pumps oil from a reservoir 40 into the delivery chamber 42 of said tensioning cylinders 38, when the gas cylinder 23 is tensioned. The tensioning yoke 37 then moves in arrow direction 43 and pulls the plunger 28 with it via the destructible means 36 until s signal generator 44 attached to said tensioning yoke 37 transmits a signal to a signal receiver 45 which is set up in a pre-adjusted position along a line 46 of the frame 25 to limit the tensioning stroke of the plunger 28.

The piston rods 47 of bounding cylinders 48 are fixed onto the thrust yoke 35 as stops. During the tensioning of the gas cylinder 23 the previously drawn out piston rods 47 are carried in arrow direction 43 by the thrust yoke 35 so that fluid from chambers 49 flows to chambers 51 via stop valves 50 until the point of time that the signal receiver 45 registers the approach of signal generator 44 and thereby the position of the plunger 28, or in other words, the required tensioning of the gas cylinder 23. At this point the corresponding stop valves 50 are closed by means of control elements 52 controlled by the signal receiver 45 in order to block the bounding cylinders 48.

Figure 2:
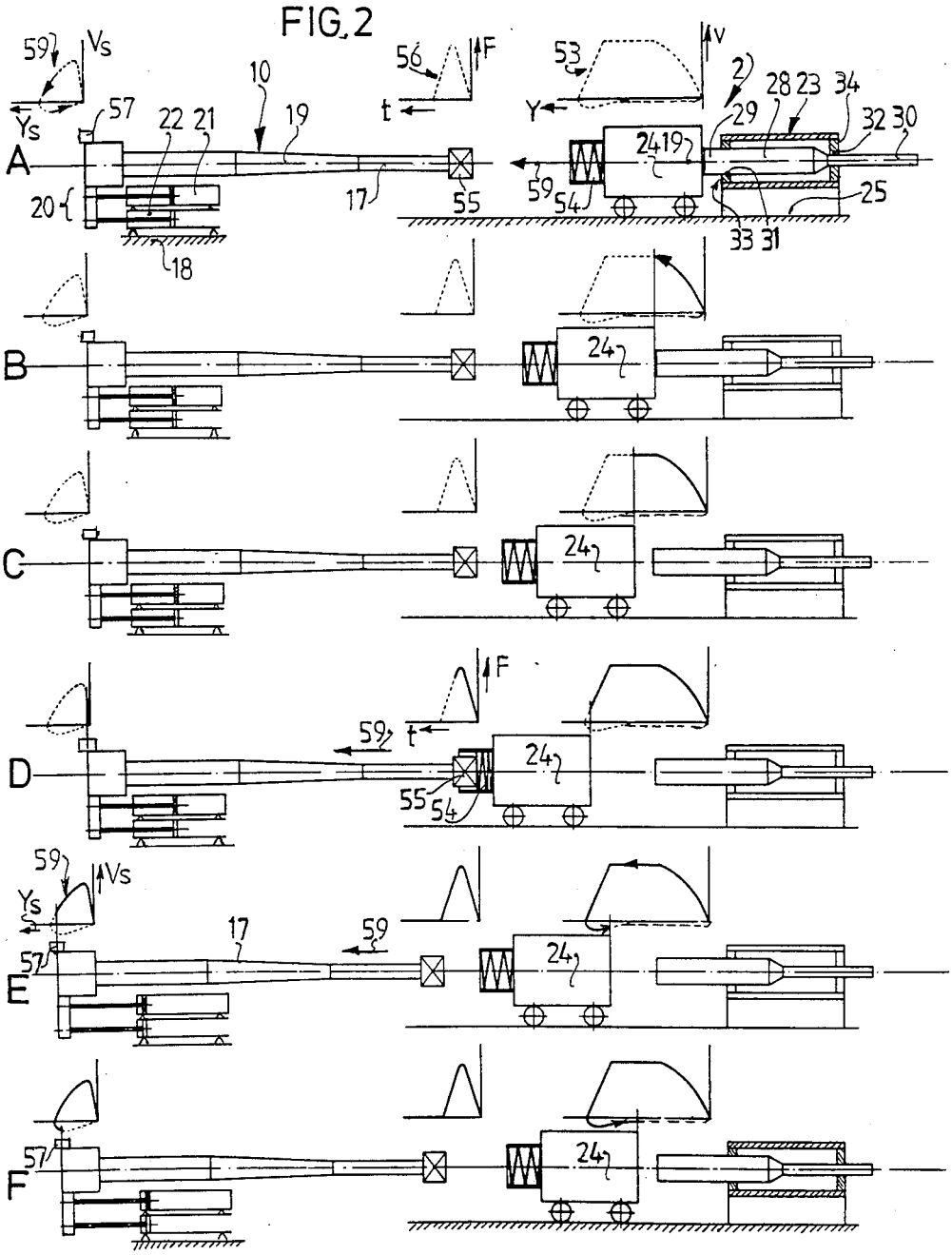

The thrust yoke 35 and the plunger 28 coupled thereto are then restrained by the piston rods 47, so that the gas cylinder 23 is no longer further tensioned. The further actuated tensioning cylinders 38 apply an increasing force on the tensioning yoke 37 and thereby on the destructible attachment means 36 connecting said tensioning yoke 37 with the plunger 28 that is held in position. This leads to destruction of the attachment means 36, resulting in the abrupt release of the plunger 28 in gas cylinder 23 whereby plunger 28 applies a thrust via the thrust yoke 35 onto the mass 24, which moves from the position of FIG. 2A in the direction 59 towards the muzzle 17, in accordance with the velocity v—trajectory Y diagram 53 shown in FIG. 2 (FIGS. 2A and 2B). The mass 24, as according to FIG. 2D, is fired against the muzzle 17 which have inserted between them spring means 54 coupled to said mass 24 and buffer means 55 coupled to said muzzle 17, which are constructed and dimensioned such that the energy transfer of said mass 24 onto the artillery piece 10 occurs according to a pre-determined force F—time t diagram 56, at the end of which said mass 24 springs back in a small travel. The muzzle 17 is thrust back in the direction 59, as according to FIG. 2E, is provided with a tachometer 57 which records the velocity $v_s$ of the muzzle 17 as a function of the trajectory $Y_s$ covered. Said tachometer 57 is, as according to FIG. 5, connected to a recorder 58 of the recording means 15, which recorder 58 draws the $v_s$–$Y_s$ test diagram. The drawn test diagram 91 is compared with the diagram band 94 prescribed per particular barrel 10, within which band said test diagram 91 should lie.

The resetting cylinder 22 of the barrel 10 operates as a spring, is filled with nitrogen gas for this purpose and, as according to FIG. 2F, returns the muzzle 17 to its initial position in FIG. 2A.

As according to FIG. 2A, the mass 24 is fired against the muzzle 17, spring means 54 and buffer means 55 being inserted between them, the latter means in fact also forming a spring means. It will be appreciated that the kinetic energy impulse transferred by the mass 24 to the ordnance piece is effected in two stages, the first in which the transfer is effected at a rapid but relatively slow rate and a second at which the transfer is effected at a higher rate. That is, the kinetic energy transfer is effected first through the spring means 54 and the buffer 55 which cushion the transfer, and when the spring means 54 and buffer are "bottomed" the transfer is effected at a high rate dictated by the velocity of the mass and how rapidly the brake mechanism of the ordnance piece can decelerate the mass 24. That is, the two stages of kinetic energy transfer occur in response to the first stage or cushioned transfer of the kinetic energy of the mass 24 through the spring means 54 and the buffer 55 and then by the second stage in which the full momentum of the mass acts upon the brake mechanism. I.e., the mass is resiliently impacted against the ordnance piece to effect this first stage of energy transfer and the second stage, during which the spring means 54 and buffer 55 are "bottomed", causes the brake mechanism of the ordnance piece directly to decelerate the mass 24 until all of the remaining kinetic energy is absorbed thereby. THe force F-time t diagram 56 in FIG. 2A is of course the time history of the forces acting on the brake mechanism of the ordnance piece simulating actual firing of the piece and is the counterpart of the velocity-trajectory diagram 91 which lies above the line Y. The force F increases form zero at a first rate (determined by the "cushioned" or resilient transfer in accord with the spring rate of the spring means 54 and buffer 55) and then at an increased rate (determined by the velocity of the mass 24) to a maximum force or peak as indicated in the diagram 56, whereafter the force F decreases to zero as the brake mechanism absorbs the last of the energy transfer and stops the mass 24. The return mechanism of the ordnance piece then returns the barrel to its original position as is indicated by the portion of the diagram 91 below the Y line, the mass having rebounded away from the barrel. The spring means 54 comprise a nitrogen cylinder 60 which forms a connection with a nitrogen cylinder 62 via an equalizing stop valve. The pistons 63 and 64 of the cylinders 60 and 62 are mutually coupled by means of a screwed connection 140, with which the total chamber volume of both cylinders 60 and 62 is adjustable, and thereby also the stroke. In order to adjust the spring rigidity of the combination of cylinders 60 and 62 to obtain a thrust diagram 56 which best approximates the F (+) diagram 56 of the impulse of the projectile to be fired by the barrel to be tested, the tensioning in both the said cylinders 60 and 62 is adjusted to a pre-determined value. To this end a nitrogen bottle 65 filled at high pressure is connected beforehand to the cylinder 60 via a stop valve 66. The spring rigidity of the spring means 54 is increased by increasing the pre-tension in said nitrogen cylinders 60 and 62.

Figure 3:
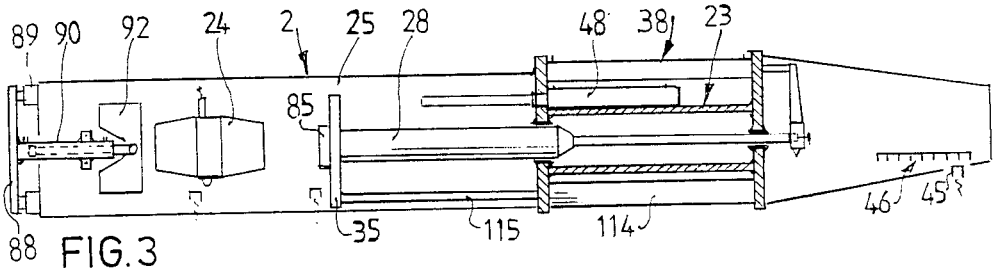
Figure 4:
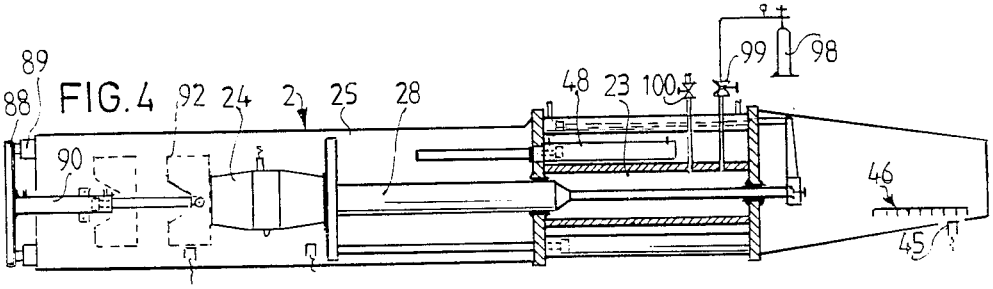

In the cylinder 60 a thrust cushion 67 of polyamide is arranged which does not come into operation if the nitrogen cylinder 60 is correctly pre-tensioned. The piston 64 is covered with an elastic cushion 68 of polyamide. A casing 69 is screwed onto the threaded end of the muzzle 17 and is locked with a nut 71. A buffer housing 73 which bears against the front and inner wall of the muzzle 17 is attached to said casing 69 with bolts 72. A buffer member 74 supports against the bottom of the buffer housing 73 via a series of spring washer 75. Said washers 75 are pre-tensioned by means of a nut 77 which is attached to a tensioning rod 78 of the buffer member 74 covered with an elastic cushion 79 of polyamide. Under the influence of the spring means 54 and buffer means 55 the mass 24 rebounds from its position of FIG. 2D to its position of FIG. 2E. In order to be able to adapt the thrust to the more or less heavily dimensioned barrel 10, the dischargeable mass 24 is, as according to FIG. 14, built up preferably of a guided mass 80, consisting of a heavy, symmetrical piece of steel which forms the housing of the cylinder 60 and 62 and which is provided with the guide members 26, and of a supplementary mass 81, which is attachable to the mass 80 by means of a ring clamp 82 and clamping bolts 83 so as to be disconnectable from it. The end 93 of the frame 25, where the barrel 10 should be set up, is coupled by means of two brake cylinders 89 with a safety yoke 88 (the "dummy previously mentioned)". which would intercept the mass 24 in the case that same is discharged without prior setting up of a barrel 10. Said safety yoke 88 is in addition provided with a hydraulic resetting cylinder 90 which is coupled with a resetting yoke 92 guided along guides 97, with which the mass 24 is driven from the position drawn in figure 2F against the thrust yoke 35 (see FIGS. 3 and 4). In order to be able to tension the gas cylinder 23 at the required predetermined tension, at which tension the plunger of said gas cylinder 23 is released abruptly, said cylinder 23 is, to adapt to the differently dimensioned barrels 10, pretensioned in its least tensioned state from FIG. 4 by addition of nitrogen gas from a nitrogen bottle 98 via a stop valve 99, as nitrogen gas is, if necessary, released via a stop valve 100. The pre-tension of the gas cylinder 23 amounts for example to 100 bar for a required tension of for example 200 bar.

In order to be able to record a velocity trajectory diagram 53, signal receivers 102, co-operating with a signal generator supported on the mass 24, are, as according to FIG. 5, arranged on the frame 25, which generate their signals to a recording device 103 driven at high speed, which in turn generates it signals to a recording device 104 driven at low speed. The output signal thereof is fed via a microprocessor 105 to a recorder 106. The measured diagram 53 should lie within the permissible limits of a diagram band 107, in order to determine whether the thrust applied to the barrel 10 has been a correct test thrust.

In order to bring the muzzle 17 and the apparatus 2 exactly in line relatively to one another, i.e. in order to lay said muzzle 17 along the axial line 19, a laser beam 110 is projected from a laser projector 111 via a mirror 112 and a theodolite 113 mounted on the muzzle 17 onto a screen 126 of the frame 25. Pivoting of the frame 25 round a vertical line of axis 123 takes place by means of a drive mechanism 120 moveably connected to the gear ring 6, while said frame 25 supports on rotor wheels 121. Pivoting of said frame 25 round a horizontal line of axis 124 is possible through attachment of the frame 25 by means of horizontal hinges 125 to the rotary crown 3. After pivoting, said frame 25 is firmly secured to the foundations 5 by means of supports 122 (see FIG. 7).

Figure 12:
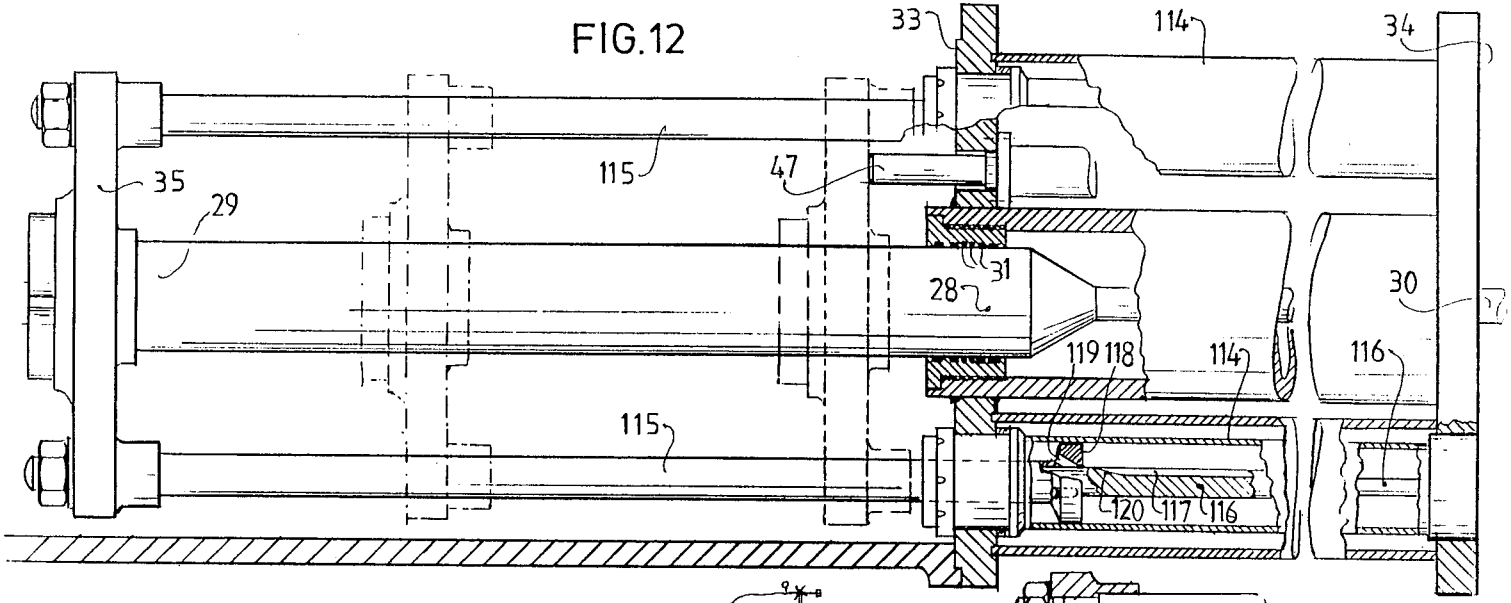

The thrust yoke 35 and the elements coupled with it are slowed down at the end of the thrust stroke by means of two brake cylinders 114, which, as according to FIG. 12, have a hollow piston rod 115 connected with the thrust yoke 35 in which a fitting throttle rod 116 is accomodated. A large groove 117 is arranged in said throttle rod 116, which corresponds with a channel 119 arranged in the piston 118. As long as said channel 119 is connected to said groove 117, the brake cylinder 114 does not brake. The braking operation of each brake cylinder 114 commences as soon as the piston 118 arrives at the end 120 of the groove 117.

Figure 14:
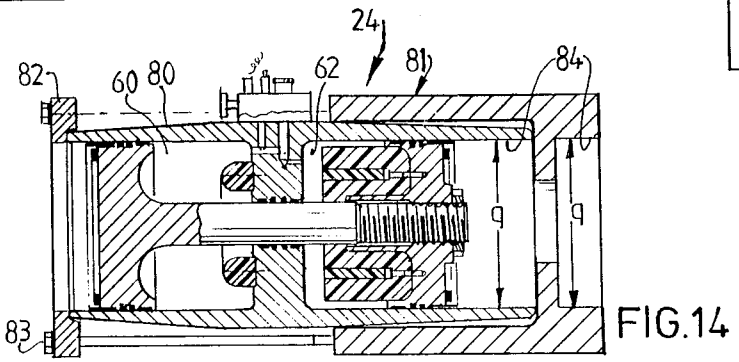
Figure 13:
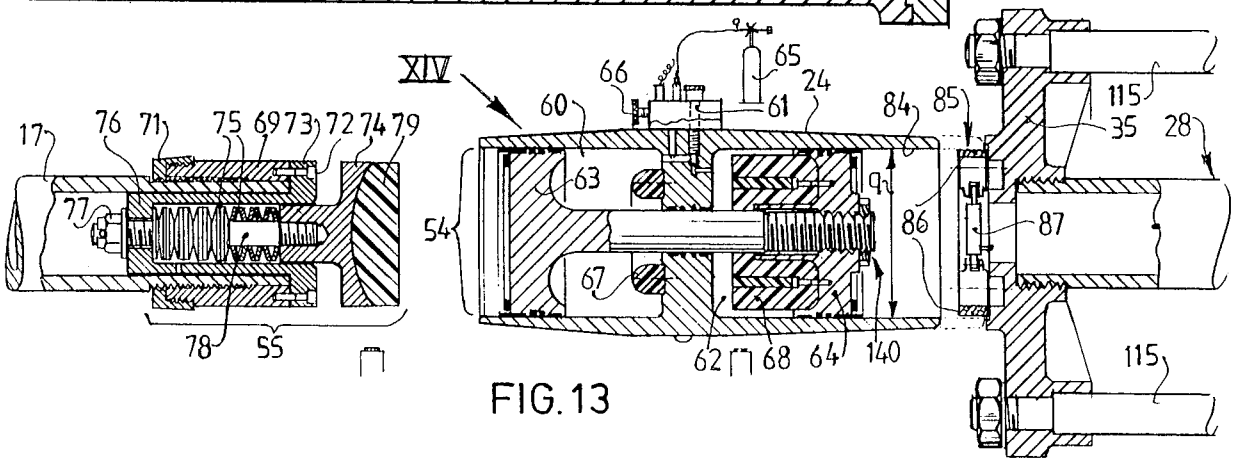

The guided mass 80 and the supplementary mass 81 have, as according to FIG. 14, an inner bore 84 on the ends turned toward the thrust yoke 35, said hole having the same diameter q, into which a carrier 85 attached to said thrust yoke 35 can fit (see FIG. 13). Said carrier 83 consists of two clamping jaws 86 which can be clamped outwards into the bore 84 by means of a hydraulic cylinder 87, in order to couple the mass 24 with the thrust yoke 35. In this way the mass 24 driven against the thrust yoke 35 can be carried further as far as its position in FIG. 2A.

Figure 11:
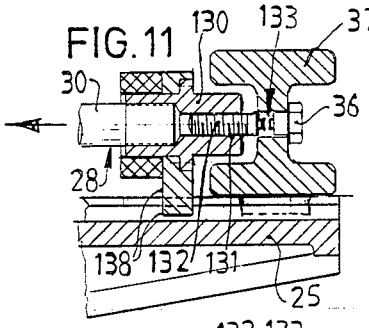
Figure 10:
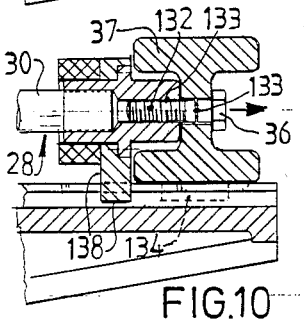
Figure 9:
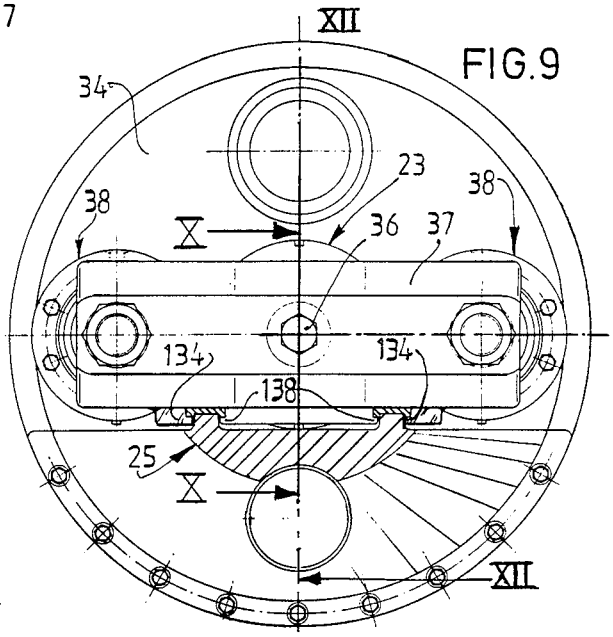

The destructible attachment means 36 comprise, as according to FIGS. 10 and 11, an attaching sleeve 130 screwed on the tensioning end 30 of the plunger 28, said means having an interior screw thread 131 for accomodating a shearing nut 132 which has a shearing position 133 with a pre-determined strength.

The tensioning force of the shearing nut 132 is at least a little greater than the pressure force which the tensioning cylinder 38 at its required tension applies to the thrust yoke 35. When the shearing nut 132 breaks, the gas cylinder 23 is abruptly released and the thrust on the mass 24 commences. The carrier 85 is disengaged from the mass 24 during the thrust of the gas cylinder 23 either manually before the release of said gas cylinder 23 or automatically, for example, under the influence of acceleration force.

The tensioning yoke 37 is guided along guides of the frame 25 by means of guide member 134. A guided yoke 138 attached to the tensioning end 30 is also guided along said guides by means of guide members 138.

What I claim is:

1. A method for testing a brake and return mechanism of an artillery barrel by applying a backward thrust to a muzzle of said barrel along the longitudinal axis of said barrel, recording a curve of the velocity-trajectory of said brake and return mechanism in response to such thrust and comparing the curve with a predetermined band of curves defining permissible limits, characterized in that the thrust on said muzzle is applied by means of at least one gas cylinder-piston assembly which is pressurized and then held in such pressurized condition by attachment means, and that thereafter the attachment means is subjected to an increasing load to the point of its destruction without further appreciable pressurizing of said gas cylinder-piston assembly, thereby permitting said cylinder-piston assembly to apply said thrust to said muzzle.

2. An apparatus for testing a brake and return mechanism of an ordnance piece having a barrel, comprising:

thrust means for applying a backward thrust on a muzzle of the barrel;

recording means for recording a curve of the velocity-trajectory of said brake and return mechanism in response to the backward thrust; and the thrust means including at least one pre-tensionable gas cylinder-piston assembly wherein the piston is released to apply the backward thrust, said piston of said gas cylinder-piston assembly is provided with destructible means.

3. An apparatus as claimed in claim 2, including means for applying relative tensioning movement to the piston of said gas cylinder-piston assembly, blocking means for blocking the relative tensioning movement of the piston of said gas cylinder-piston assembly.

4. An apparatus for testing a brake and return mechanism of a barrel, comprising:

thrust means for applying a backward thrust on a muzzle of a barrel;

recording means for recorcind a curve of the velocity-trajectory of said brake and return mechanism in response to said backward thrust;

at least one pre-tensionable gas cylinder-piston assembly having a piston which is to be released, the assembly including tensioning means comprising at least two tensioning cyliinders arranged on either side of the gas cylinder-piston assembly and afixed onto a shared tensioning yoke, and destructible means which couples said yoke and said piston of said gas cylinder-piston assembly for releasing said piston from said yoke, thereby permitting said thrust means to apply said backward thrust after said tensioningg means has exceeding a predetermined tension.

5. An apparatus as claimed in claim 2 including safety means for intercepting a dischargeable mass in case the barrel to be tested is missing.

6. The method of applying an energy impulse to an ordnance piece having a barrel and brake and return mechanism to approximate the time history of forces which would be imposed upon the piece during actual firing of the piece, which comprises the steps of:

(a) imparting a predetermined kinetic energy to a mass;

(b) transferring the kinetic energy of the mass to the brake and return mechanism through the barrel and along a line corresponding with the longitudinal axis of the barrel of the ordnance piece; and (c) controlling the kinetic energy imparted to the mass in step (a) and the rate at which the kinetic energy transfer of step (b) is effected to impose a force upon the brake and return mechanism which increases with time from zero, builds to a peak and then decreases to zero during the kinetic energy transfer of step (b), thereby approximating the forces acting upon the brake and return mechanism during actual firing of the piece.

7. The method as defined in claim 6 including the step of recording the time history of forces of the energy transfer of step (b).

8. The method as defined in claim 6 wherein step (a) is effected by subjecting a member engaging the mass to a predetermined gas pressure, restraining the member in position while the predetermined gas pressure prevails and releasing the member to impel the mass by destruction of the restraint.

9. The method as defined in claim 6 wherein the control of the rate at which the kinetic energy is transferred in step (c) is effected by interposing spring mechanism between the mass and a muzzle of the barrel or safety means.

10. A method of applying an energy impulse to an ordnance piece having a barrel and brake and return mechanism, which energy impulse approximates a time history of forces imposed on the barrel during actual firing of the piece so as to test the brake and return mechanism of the piece, which comprises the steps of:

(a) positioning a mass of predetermined weight in spaced relation to one end of the barrel;

(b) imparting predetermined kinetic energy to the mass while directing it toward the end of the barrel along a path which is parallel with the longitudinal axis of the barrel;

(c) resiliently impacting the mass against the end of the barrel; and (d) controlling the weight of the mass, the resiliency of impacting the mass against the end of the barrel and the kinetic energy imparted to the mass to approximate the time history of forces acting upon the barrel and transmitted to the brake and return mechanism during actual firing of the piece.

11. The method as defined in claim 10 including the step of recording the time history of forces imparted to the end of the barrel.

12. The method as defined in claim 10 wherein step (b) is efffected by subjecting a member engaging the mass to a predetermined gas pressure, restraining the member in position and thereafter releasing the member to impel the mass by destruction of the restraint.

13. The method as defined in claim 10 wherein the control of the resiliency of impacting the mass is effected by interposing spring mechanism between the mass and the end of the barrel.

14. The method as defined in claim 13 wherein step (b) is effected by subjecting a member engaging the mass to a predetermined gas pressure, restraining the member in position and releasing the member to impel the mass by destruction of the restraint.

15. The method as defined in claim 14 including the step of recording the time history of forces as imparted to the end of the barrel during step (c).

16. A method of testing a brake and return mechanism for an ordnance piece by approximating the time history of forces imposed upon the piece during actual firing of the piece, which comprises the step of:

(a) imparting predetermined kinetic energy to a mass;

(b) transferring the kinetic energy imparted to the mass in step (a) to the brake and return mechanism in two successive stages along a line corresponding with the longitudinal axis of a barrel of the ordnance piece, wherein the first stage is cushioned;

(c) controlling the kinetic energy imparted to the mass in step (a) and the rates at which the kinetic energy is transferred in step (b) to impose a force upon the brake mechanism which increases with time, builds to a peak and then decreases to zero during the kinetic energy transfer of step (b), thereby approximating the forces acting upon the recoil mechanism during actual firing of the piece;

(d) recording a velocity-trajectory curve of said brake and return mechanism; and (e) comparing said curve to a predetermined band of curves which define permissible limits.

17. The method as defined in claim 16 including the step of recording the time history of forces of the transfer of step (b).

18. The method as defined in claim 17 wherein step (a) is effected by subjecting a member engaging the mass to a predetermined gas pressure, restraining the member in position and releasing the member to impel the mass by destruction of the restraint.

19. The method as defined in claim 18 wherein the control of the energy transfer of step (c) is effected by interposing spring mechanism between the mass and the piece.

20. The method as defined in claim 16 wherein step (a) is effected by subjecting a member engaging the mass to a predetermined gas pressure, restraining the member in position and releasing the member to impel the mass by destruction of the restraint.

21. The method as defined in claim 20 including the step of recording the time history of the forces during the energy transfer of step (b).

22. A method of applying an energy impulse to a brake and return mechanism of an ordnance piece to approximate the time history of forces which would be imposed upon the piece during actual firing of the piece, which comprises the steps of:

(a) imparting a predetermined kinetic energy to a mass;

(b) directing the mass along a path corresponding to a longitudinal axis of a barrel of the ordnance piece and (c) transferring the kinetic energy of the mass to the brake and return mechanism in two stages of deceleration of the mass, the first stage of deceleration being relatively gradual with respect to the second stage.

23. The method as defined in claim 22 wherein said first stage of deceleration is effected by cushioning the mass and the second stage of deceleration is effected by terminating such cushioning.

24. Apparatus for testing a brake and return mechanism of an ordnance piece, which comprises the combination of:

mass means for imparting a kinetic energy impulse to the ordnance piece which approximates the time history of forces which would be imposed thereon during actual firing of the piece;

thrust means for imparting predetermined kinetic energy to said mass means;

means for guiding said mass means along a path aligned with a bore of and to impact the ordnance piece and transfer the predetermined kinetic energy of the mass means to the ordnance piece;

means for recording the force/time diagram of the predetermined kinetic energy imparted by the mass means to the ordnance piece; and means for recording a velocity-trajectory curve of said brake and return mechanism, whereby said curve may be compared to a predetermined band of curves defining permissible limits.

25. Apparatus as defined in claim 24 wherein said mass means includes spring mechanism to impose a force upon the ordnance piece which increases with time, builds to a peak and then decreases to zero during the kinetic energy impulse thereby approximating the time history of forces acting upon the brake and return mechanism during actual firing of the piece.

26. Apparatus as defined in claim 25 wherein said thrust means comprises a member engaging the mass means, piston/cylinder means for subjecting said member to a predetermined gas pressure, means for restraining the member in position engaging said mass means and means for releasing the member to impel the mass by destruction of the restraining means.

27. Apparatus as defined in claim 26 wherein said means for restraining includes a destructible attachment means connected to the piston of said piston/cylinder means and said means for releasing exerts pressure upon said attachment means for destroying the attachment means to release the piston.

* * * * *